US011885218B2

(12) United States Patent
Lie et al.

(10) Patent No.: US 11,885,218 B2
(45) Date of Patent: Jan. 30, 2024

(54) ADAPTIVE PULSE WAVEFORM FOR CHANNEL ESTIMATION IN MUD PULSE TELEMETRY

(71) Applicant: Halliburton Energy Services, Inc., Houston, TX (US)

(72) Inventors: Joni Polili Lie, Houston, TX (US); Mukul M. Agnihotri, Houston, TX (US); Faisal Shah, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 284 days.

(21) Appl. No.: 17/222,305

(22) Filed: Apr. 5, 2021

(65) Prior Publication Data

US 2022/0316326 A1 Oct. 6, 2022

(51) Int. Cl.
*E21B 47/20* (2012.01)

(52) U.S. Cl.
CPC ..... *E21B 47/20* (2020.05)

(58) Field of Classification Search
CPC ..... E21B 47/20; E21B 47/18
See application file for complete search history.

(56) References Cited

U.S. PATENT DOCUMENTS

| | | | | |
|---|---|---|---|---|
| 6,469,637 | B1 | 10/2002 | Seyler | |
| 2007/0132606 | A1 | 6/2007 | Reckmann et al. | |
| 2017/0234124 | A1 | 8/2017 | Dang | |
| 2017/0332157 | A1 | 11/2017 | White et al. | |
| 2021/0189869 | A1* | 6/2021 | Zheng | E21B 47/18 |
| 2021/0189872 | A1* | 6/2021 | Miller | E21B 47/13 |

FOREIGN PATENT DOCUMENTS

| | | | |
|---|---|---|---|
| EP | 0617196 | B1 | 9/1994 |
| GB | 2349404 | A | 11/2000 |
| WO | WO 2016/095027 | A1 | 6/2016 |
| WO | WO 2017/019002 | A1 | 2/2017 |
| WO | WO 2017/062009 | A1 | 4/2017 |

OTHER PUBLICATIONS

Search Report and Written Opinion issued for International Patent Application No. PCT/US2021/025756, dated Jan. 3, 2022, 10 pages, ISR/KR.

* cited by examiner

*Primary Examiner* — Nabil H Syed
*Assistant Examiner* — Cal J Eustaquio
(74) *Attorney, Agent, or Firm* — NOVAK DRUCE CARROLL LLP

(57) ABSTRACT

Downhole telemetry systems and related methods to adaptively adjust pulse waveform width through digitally controlled pulsing parameters.

20 Claims, 10 Drawing Sheets

ADAPTIVE PULSE WAVEFORM FOR CHANNEL ESTIMATION IN MUD PULSE TELEMETRY

FIELD OF THE DISCLOSURE

The present disclosure relates generally to downhole telemetry and, more specifically, to a method and system to adaptively adjust the width and duration of pulse waveforms in mud pulse telemetry systems.

BACKGROUND

Mud pulse telemetry generally involves telemetry of information from a bottom location of a wellbore to a surface of the earth during oil well drilling operations. The information communicated through mud pulse telemetry can include various parameters, such as pressure, temperature, direction of the wellbore, deviation of the wellbore, density, porosity, characteristics of the wellbore layers, etc. This information can be extremely helpful for optimizing the efficiency and accuracy of a drilling operation.

Channel estimation in mud pulse telemetry aims to characterize the mud channel propagation during drilling. Mud pulse telemetry relies on accurate channel estimates to ensure robust and reliable real time telemetry for logging-while-drilling ("LWD") and measurement-while-drilling ("MWD") operations. Most often the channel estimation relies on the downhole pulser to send apriori known pseudorandom sequence of pulses. The surface telemetry system then detects this sequence and estimates its mud channel in real time.

However, due to various uncertainties caused by drilling conditions, as well as the pressure excitation mechanism in the downhole pulser, its pseudorandom properties may be distorted during the course of the signal's propagation. Further, unlike the solenoid driven pulse waveform excitation mechanism, the electric motor driven mechanism promises robust and low-cost-low-maintenance approach to generate pulse waveforms in the downhole pulser. Despite its low-cost promise, the electric motor driven pulse introduces delay and transient effect to the resulting pulse waveform. These distortion effects vary depending on the mud viscosity, flow rate and other drilling conditions.

Furthermore, during the channel estimation stage, the surface telemetry system assumes the signal transmitted by the downhole pulser is strictly following an ideal rectangular-shape pulse according to its pseudorandom sequence. In practice, instead of rectangular pulse shape, the pressure variation induced resembles more of a non-ideal trapezoidal shape with undershoot and overshoot transients occurring at both parallel sides. This translates to distortion/noise in the spectrum of its pseudorandom sequence. While the effect of both undershoot and overshoot, as well as the upward slope and downward slope, can be mitigated with low pass filtering, the distortion to its pseudorandom spectrum introduces additional error in channel estimation.

BRIEF DESCRIPTION OF THE DRAWINGS

FIG. 4A is a waveform generated with a 50 ms rise time, while

DESCRIPTION OF ILLUSTRATIVE EMBODIMENTS

Illustrative embodiments and related methods of the present disclosure are described below as they might be employed in a mud pulse telemetry system and method to adaptively adjust the width and duration of pulse waveforms. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As will be described below, the present disclosure provides systems and related methods to adaptively adjust pulse waveform width and duration through digitally controlled pulsing parameters. As a result of the duration adjusted waveform, channel estimation errors are minimized or alleviated, thus providing more robust mud pulse telemetry. In a generalized method, a first pulse waveform is generated using a first controller communicably coupled to a downhole pulser, the first pulse waveform having a first pulse width. The first pulse waveform propagates along the wellbore and is detected by a second controller. The second controller then perform channel estimation of the detected first pulse waveform. The second controller determines whether the channel estimate meets a quality threshold. Responsive to that determination, the second controller transmits a stretch factor signal from the second controller to the first controller to adjust the first pulse width to a second pulse width. The first controller then generates a second pulse waveform having the second pulse width. The second pulse waveform is propagated along the wellbore where it is ultimately detected by the second controller.

Figure 1:
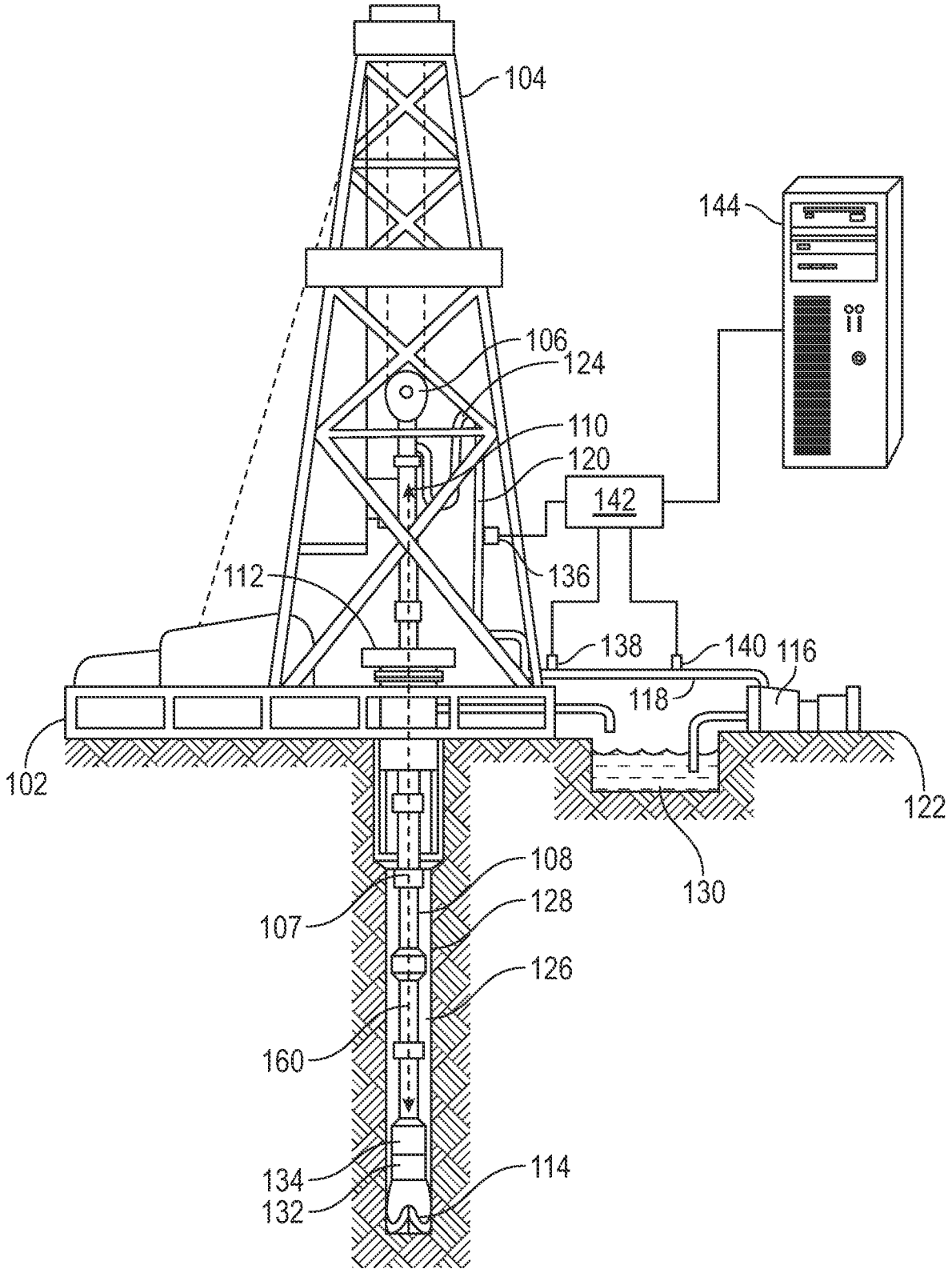
FIG. 1 shows an illustrative drilling system having mud pulse telemetry components of the present disclosure.

FIG. 1 shows an illustrative drilling system having mud pulse telemetry components of the present disclosure. A drilling platform 102 can be equipped with a derrick 104 that supports a hoist 106. The drilling platform is supported directly on land as shown or on an immediate platform if at sea. A string of drill pipes is connected together by tool joints 107 so as to form a drill string 108. The hoist 106 suspends a top drive 110 that can rotate the drill string 108 and can lower the drill string through the wellhead 112. Connected to the lower end of the drill string 108 is a drill bit 114 that has been advanced into the earth from the earth's surface 122 to form wellbore 128. The drill bit 114 can be located at a bottom, distal end of the drill string 108 and can be rotated by rotating the drill string 108, by use of a downhole motor near the drill bit, or by a combination of each method. Drilling fluid (also referred to as "mud") can be pumped by mud pump 116 through flow line 118, stand pipe 120, goose neck 124, top drive 110, and down through the drill string 108 at high pressures and volumes to emerge through nozzles or jets in the drill bit 114. The drilling fluid can then travel back up the wellbore 128 via the annulus 126 formed between the exterior of the drill string 108 and the wall of wellbore 128. At the surface 122, the drilling fluid exits the annulus 126 through a blowout preventer (not specifically shown) and can drain into a mud pit 130 on the surface 122. On the surface 122, the drilling fluid can be cleaned and recirculated down the drill string 108 by mud pump 116.

As shown in FIG. 1, the drill string 108 can support several components along its length. In wells employing MWD or LWD, a sensor unit 132 collects data regarding the formation properties and/or various drilling parameters near the drill bit 114. The collected data can include such properties as formation fluid density, temperature, pressure, resistivity, porosity, and azimuthal orientation of the drill bit 114 or drill string 108. Furthermore, the sensor unit contains one or more transducers for measuring the pressure within the drill string 108. Other sensor units can be disposed along the drill string 108 which can be similarly enabled to sense nearby characteristics and conditions of the drill string 108, formation fluid, and surrounding formation. Regardless of which conditions or characteristics are sensed, data indicative of those conditions and characteristics is either recorded downhole, for instance at a processor within sensor unit 132 for later download, or communicated to the surface either by mud pulse telemetry, wire, wirelessly or otherwise. Power for the sensor units and communication module may be provided by batteries housed therein. Alternatively, power may be generated from the flow of drilling mud through the drill string 108 using turbines as is known in the art.

The sensor unit 132 can be coupled to a controller/communication module 134 that can transmit the collected data to the surface 122 via communication path 160. Alternatively, sensor unit 132 and communication module 134 can receive signals from the surface 122 or can transmit/receive data to or from other sensor units and communication modules disposed along the drill string 108. In wells employing mud pulse telemetry, communication module 134 can modulate the resistance to the incoming flow of drilling fluid to generate pressure pulses (positive/negative pulse systems) or a carrier frequency (continuous wave pulse system) that propagate to the surface 122. In such mud pulse telemetry systems, communication module 134 forms part of a mud pulser that generates the pulse waveforms using, for example, an electric motor. Various transducers, such as transducers 136, 138 and 140, can convert the pressure signal into electrical signals for a signal digitizer 142 (e.g., an analog to digital converter). While three transducers 136, 138 and 140 are illustrated at specific locations, a greater or fewer number of transducers may be used and may be disposed at different locations of the surface 122 or within the wellbore 128. The digitizer 142 supplies a digital form of the pressure signals to one or more processor 144 or some other data processing device. Processor 144 operates in accordance with software (which may be stored on a computer-readable storage medium) to process and decode the received signals.

As previously discussed, for mud pulse telemetry the communication module 134 generates a traveling pressure signal representative of downhole parameters measured by sensor unit 132. In an ideal system, each and every pressure pulse created downhole would propagate upstream and be easily detected by a transducer at the surface. However, drilling fluid pressure fluctuates significantly and contains noise from several sources (e.g., bit noise, torque noise, and mud pump noise, etc.) as well as self-induced interferences due to reflections and refractions when the fluid pressure propagates along the drill pipe. To combat noise and interference, communication module 134 can generate and transmit a signal including a preamble waveform constructed from the pseudorandom sequence and used to estimate the communication channel. The signal can be transmitted as a pressure signal by modulating the flow of mud using any mud pulse telemetry technique known in the art such as negative pulse, positive pulse, continuous wave, or any combination thereof. The pressure signal travels along communication path 160 toward the surface 122 of the wellbore 128. Once the signal has reached the surface 122 of the wellbore 128, the signal is measured by at least one of transducers 136, 138, and 140. Data from the signal, which can include the preamble, data collected by sensor unit 132, and/or other data symbols, can be digitized by digitizer 142 and sent (wired or wirelessly) to one or more processor 144 for recordation and/or processing. Upon receipt of the signal data, processor 144 can perform detection of the preamble waveform and/or other portions of the signal and can estimate characteristics of the communication channel. Moreover, other communication modules and sensor units disposed along the drill string 108 can receive and process the signal to estimate the communication channel.

Alternatively or in addition, flow of the drilling fluid that is pumped via mud pump 116 can be modulated at the surface 122 to generate and transmit a signal including a preamble waveform. The signal can be transmitted using mud pulse telemetry, by varying the rotation rate of the drill string 108, or by any other technique known in the art. The signal can travel along communication path 160 toward the bottom of the wellbore 128. The signal can be received by a transducer located within or proximal to sensor unit 132 or communication module 134. Data from the signal received by the transducer can be digitized and transmitted (wired or wirelessly) to a processor disposed within sensor unit 132 or communication module 134. The processor can perform detection of the preamble waveform and/or other portions of the signal and can estimate characteristics of the communication channel. Moreover, other communication modules and sensor units disposed along the drill string 108 can receive and process the signal to estimate the communication channel.

Although the presently disclosed channel estimation technique is described above with respect to MWD/LWD using mud pulse telemetry, it can be suitably employed with any method of communication between a downhole and a surface location, as well as for communications between downhole locations. For example, the principles disclosed herein can apply to wireline communications, wireless communications, acoustic communications, structural members, or other signal transmissions where the waveform travels from downhole to surface, surface to downhole, or between communication points of the pipe, and encounters attenuation and distortion. For example, if communicating via wireline communications, the system can utilize wireline deployed as an independent service upon removal of the drill string, the drill string itself, or other conductive mechanisms for communicating. If wirelessly, a downhole transceiver (antenna) can be utilized to send data to a topside transceiver (antenna), or vice versa.

The controllers, communication modules, etc. described herein may contain all necessary software to perform the methods as described herein. Although not shown, this illustrative controllers or modules include at least one processor, a non-transitory, computer-readable storage (e.g., local memory), transceiver/network communication module, optional I/O devices, and an optional display (e.g., user interface), all interconnected via a system bus. Software instructions executable by the processor for implementing software instructions in accordance with the illustrative embodiments and methods described herein, may be stored in a local storage medium or some other computer-readable medium. Although not explicitly shown in FIG. 1, it will be recognized the controllers, modules, etc. may be connected to one or more public and/or private networks via one or more appropriate network connections via a network communication module. It will also be recognized that the software instructions comprising the methods described herein may also be loaded into local storage from appropriate storage media (e.g. a portable memory/hard drive, a CD-ROM, or the like) via wired or wireless methods.

Moreover, those ordinarily skilled in the art will appreciate that the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Figure 2A:
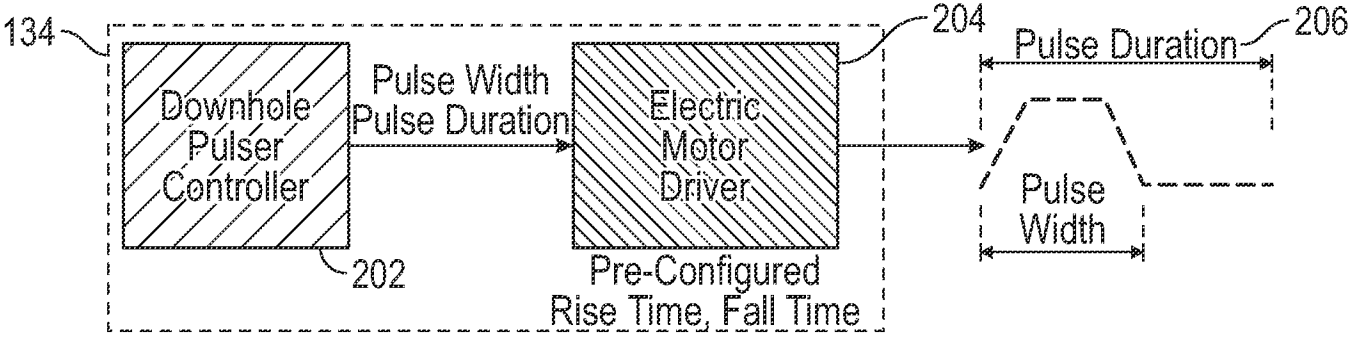
FIG. 2A is a block diagram of communication module illustrating how a downhole pulser controller generates pulsing control parameters defining pulse width and pulse duration, according to one illustrative embodiment of the present disclosure.
Figure 2B:
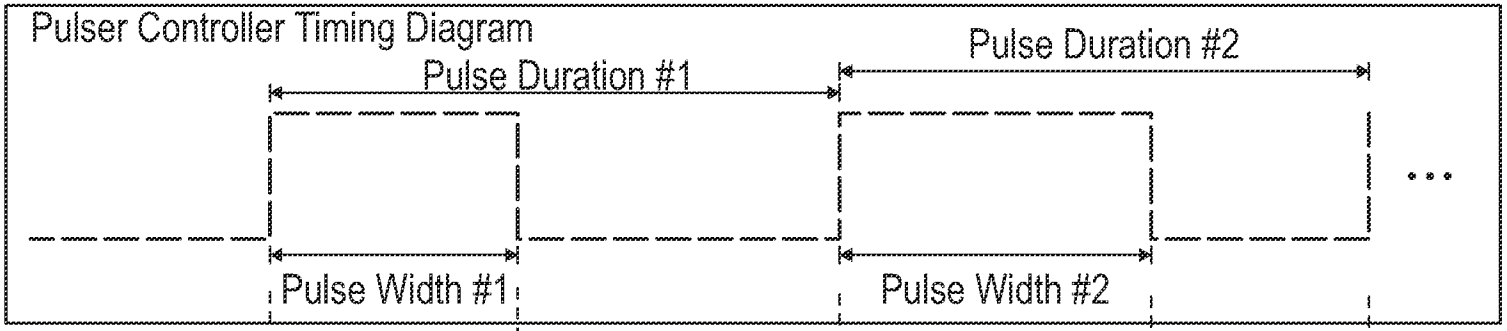
FIG. 2B illustrates timing diagram generated by the pulser controller of FIG. 2A.
Figure 2C:
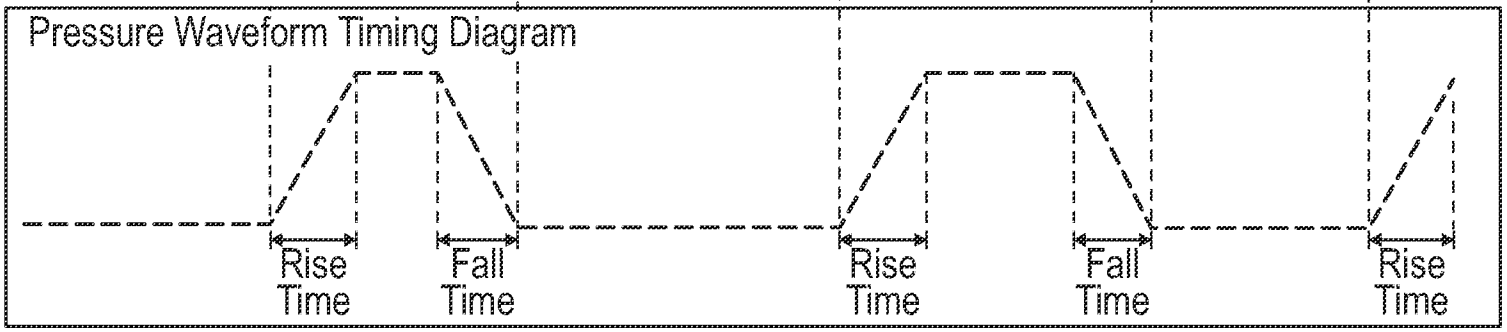
FIG. 2C is the timing diagram of the pressure waveform generated by the electric motor driver as a result of the input of the timing diagram of FIG. 2B.
Figure 3A:
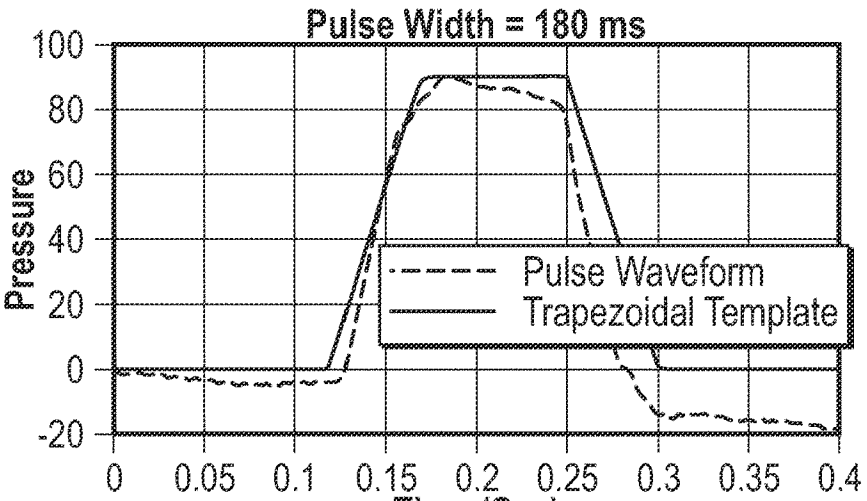
FIG. 3A is a graph showing the template and generated pressure waveform having a width of 180 ms.
Figure 3B:
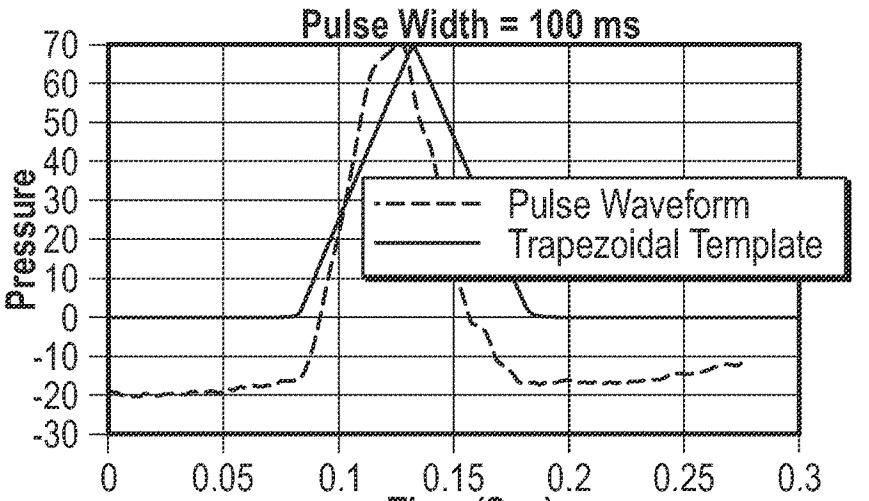
FIG. 3B is a graph showing the template and generated pressure waveform having a width of 100 ms.
Figure 3C:
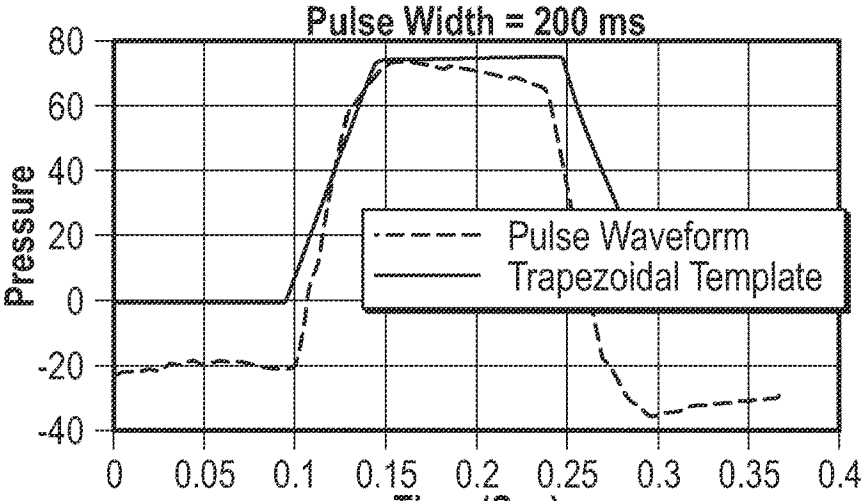
FIG. 3C is a graph showing the template and generated pressure waveform having a width of 200 ms.
Figure 3D:
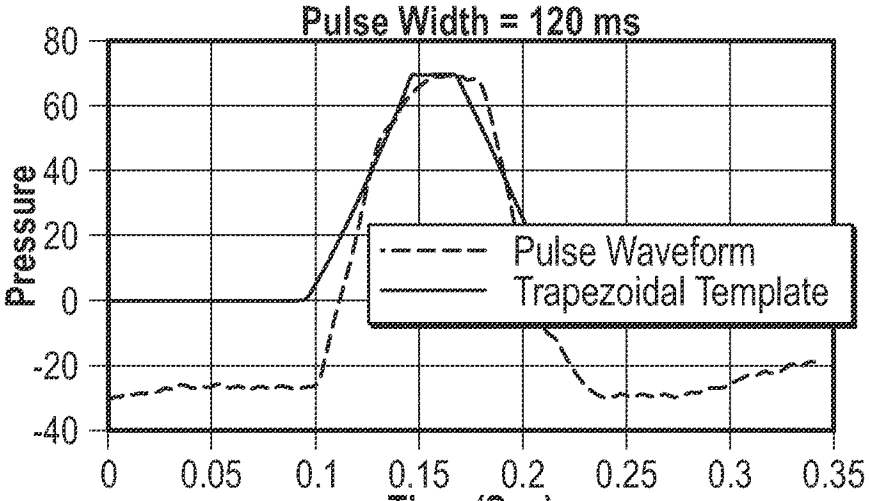
FIG. 3D is a graph showing the template and generated pressure waveform having a width of 120 ms.

FIGS. 2A-2C illustrate how pulse waveforms are generated by communication module 134 using digitally controlled pulsing parameters and the electric motor driver, according to certain illustrative embodiments of the present disclosure. FIG. 2A is a block diagram of communication module 134 illustrating how a downhole pulser controller 202 utilizes pre-configured and digitally stored pulsing control parameters defining pulse width and pulse duration. These parameters are communicated to electric motor driver 204 to then generate the rise and fall times of the resultant pulse waveform 206 having the pulse duration and pulse width as defined by the pulsing control parameters.

FIG. 2B illustrates timing diagram generated by pulser controller 134. As can be seen, the waveform includes two pulses having approximately the same pulse duration. However, width of the first pulse is smaller than the width of the second pulse. FIG. 2C is the timing diagram of the pressure waveform generated by the electric motor driver 204 (as a result of the input of the timing diagram of FIG. 2B. As can be seen, the rise and fall times of the pressure waveforms correspond to the width of the pulses in the timing diagram of FIG. 2B. However, the pressure waveforms reflect a trapezoidal shape rather than the rectangular shape of the timing diagram of FIG. 2B.

FIG. 3 illustrates four graphs (pressure vs. time) showing the trapezoidal template (of the timing diagram) and pressure waveform of the generated pulse that has been recorded using a pressure transducer directly above the downhole pulser. FIG. 3A is a graph showing the template and generated pressure waveform having a width of 180 ms. FIG. 3B is a graph showing the template and generated pressure waveform having a width of 100 ms. FIG. 3C is a graph showing the template and generated pressure waveform having a width of 200 ms. FIG. 3D is a graph showing the template and generated pressure waveform having a width of 120 ms. With varying pulse width while keeping the rise time constant, the shape of the generated pressure waveforms resemble a trapezoidal shape instead of rectangle one (as reflected in the templates). FIG. 3B illustrates one particular cases when the pulse width equals the addition of its rise time and fall time, the resulting pulse waveform (of FIG. 3B) resembles a triangular shape (a trapezoidal without the top parallel side).

Figure 4A:
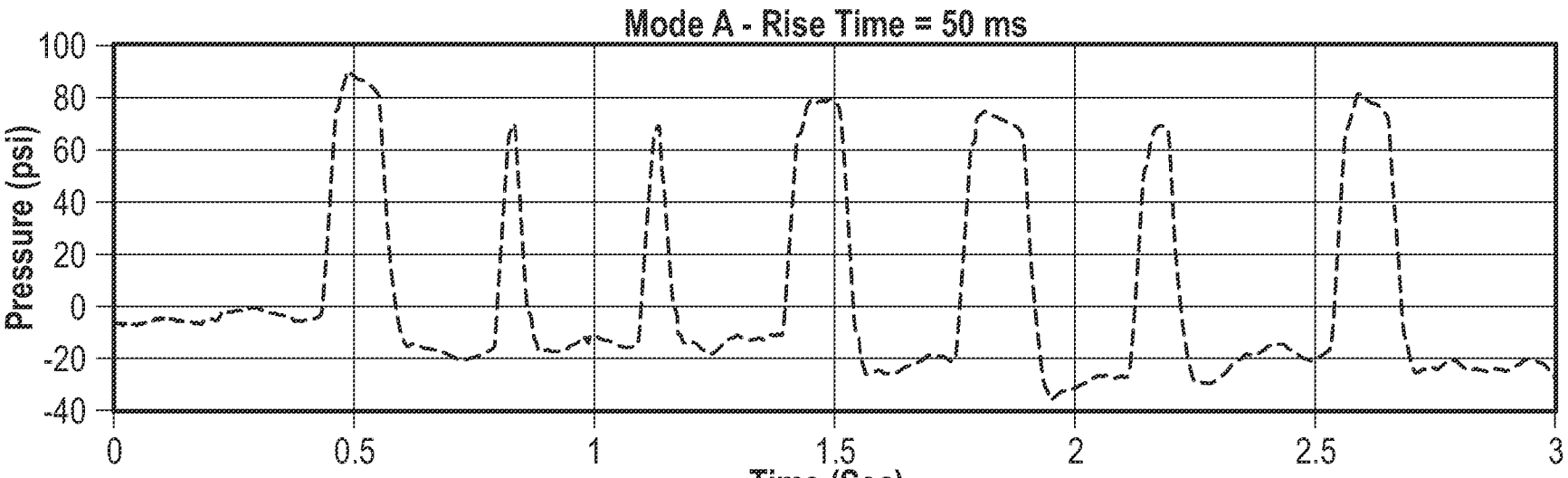
Figure 4B:
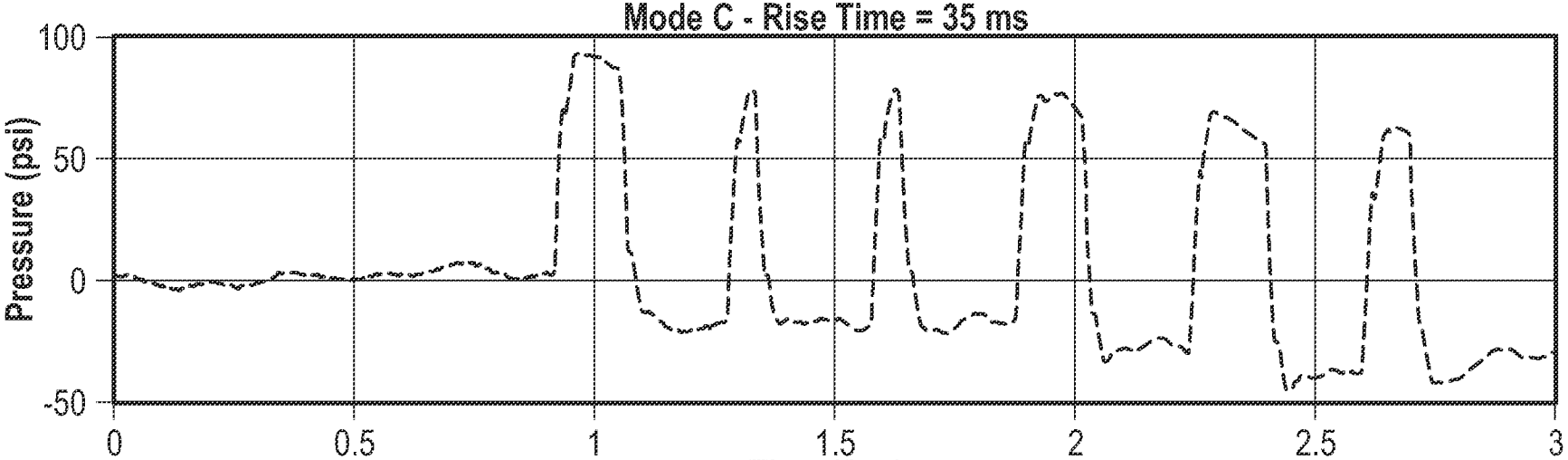
FIG. 4B is a waveform generated with a 35 ms rise time.
Figure 5A:
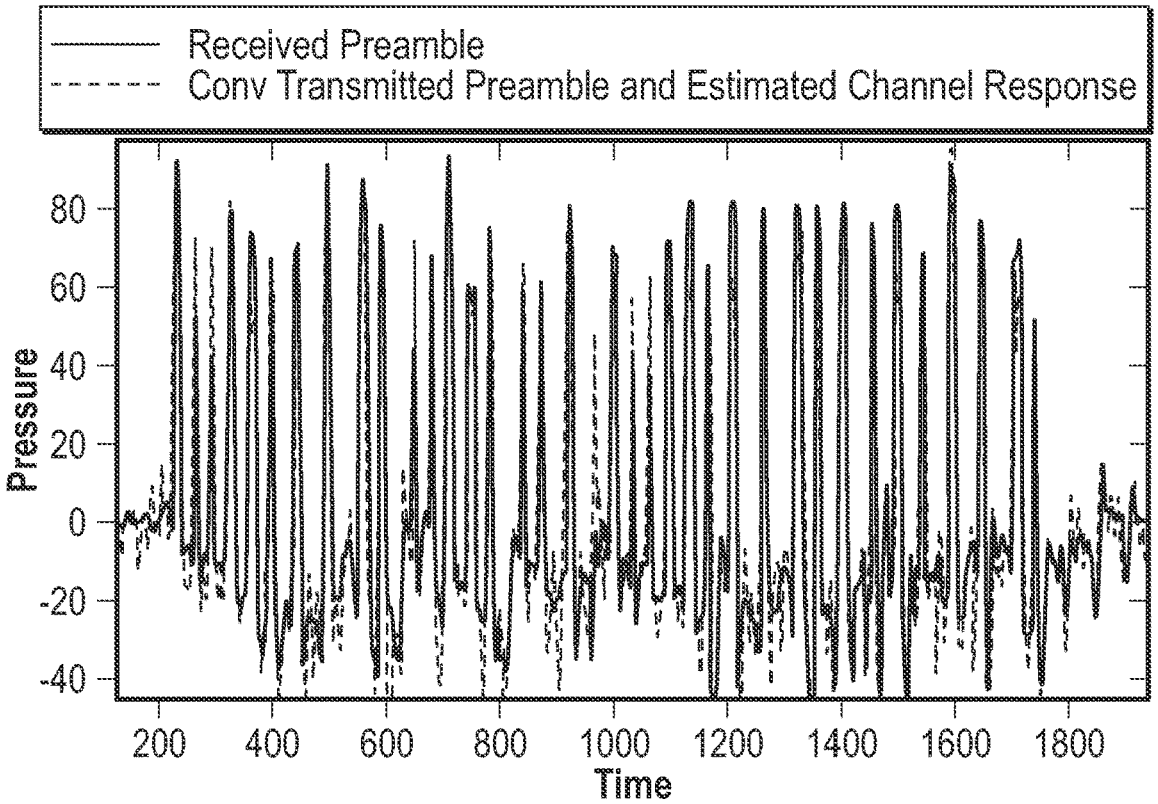
FIG. 5A is a graph (pressure vs. time) showing received pressure waveforms detected at the surface due to the transmission of the pseudorandom sequence being compared with the reconstructed pressure waveform from the result of the convolution between the estimated channel response and the transmitted preamble.
Figure 5B:
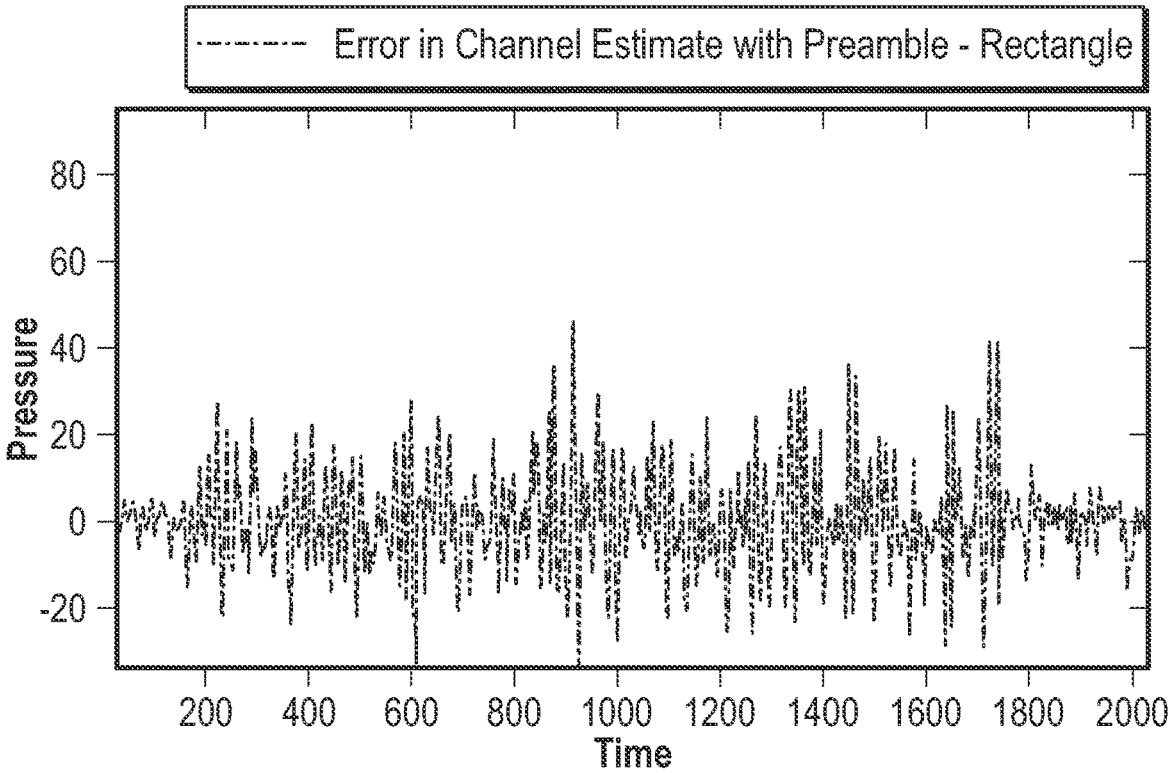
FIG. 5B is a graph showing the channel estimate error as a function of time calculated from the difference between the two waveforms of FIG. 5A.

FIG. 4 shows two graphs reflecting the generation of the pseudorandom sequences of pulses comprised of continuous pulses with varying pulse width and duration parameters. FIG. 4A is a waveform generated with a 50 ms rise time, while FIG. 4B is a waveform generated with a 35 ms rise time. Notice how the rise time parameters configured by the controller affect the shape of the pulse waveform. Without taking into account this effect (as in conventional approaches), the estimated channel response will include errors from the discrepancy between the generated pressure/pulse waveform and the pseudorandom sequence (FIG. 2C or the trapezoidal template). This is demonstrated in FIGS. 5A and 5B, with FIG. 5A being a graph (pressure vs. time) show the received pressure waveforms at the surface due to the transmission of the pseudorandom sequence (also known as the preamble) being compared with the reconstructed pressure waveform from the result of the convolution between the estimated channel response and the transmitted preamble. FIG. 5B is a graph showing the channel estimate error as a function of time calculated from the difference between the two waveforms of FIG. 5A. As can be seen, the channel estimate error is large in conventional approaches.

Figure 6:
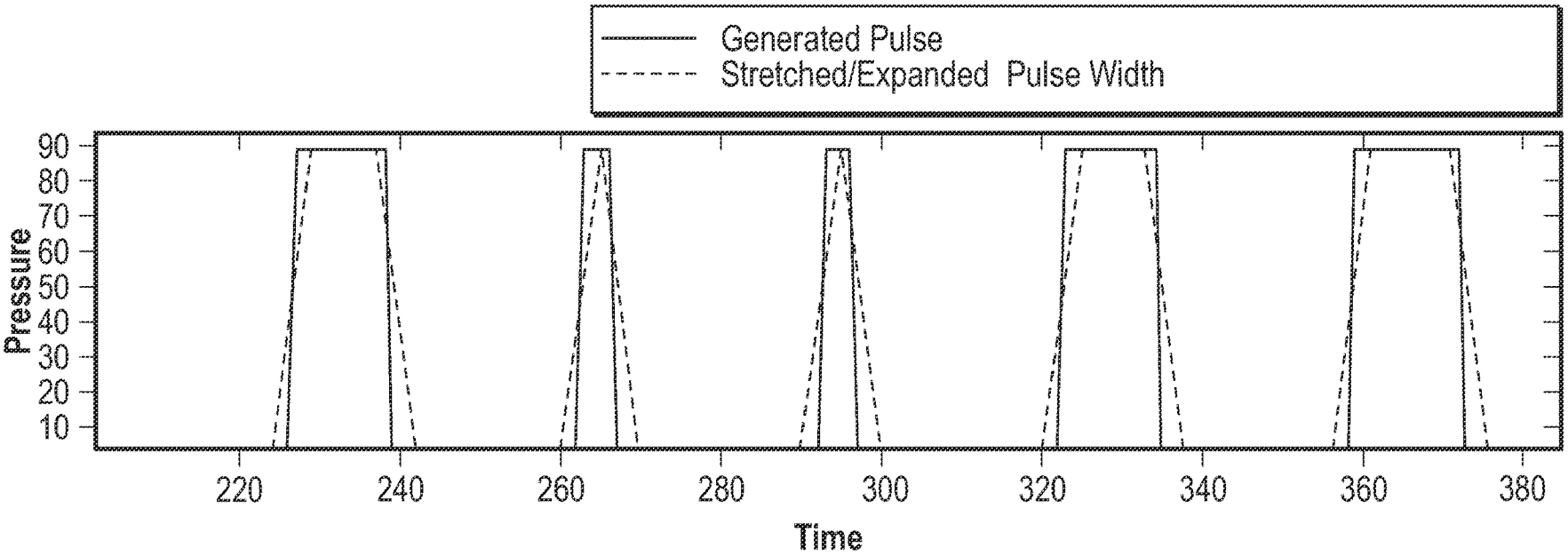
FIG. 6 is a graph showing a stretched or expanded pulse width that generates the effective pulse also shown in the graph, thereby reducing and/or alleviating the channel estimate error.
Figure 7A:
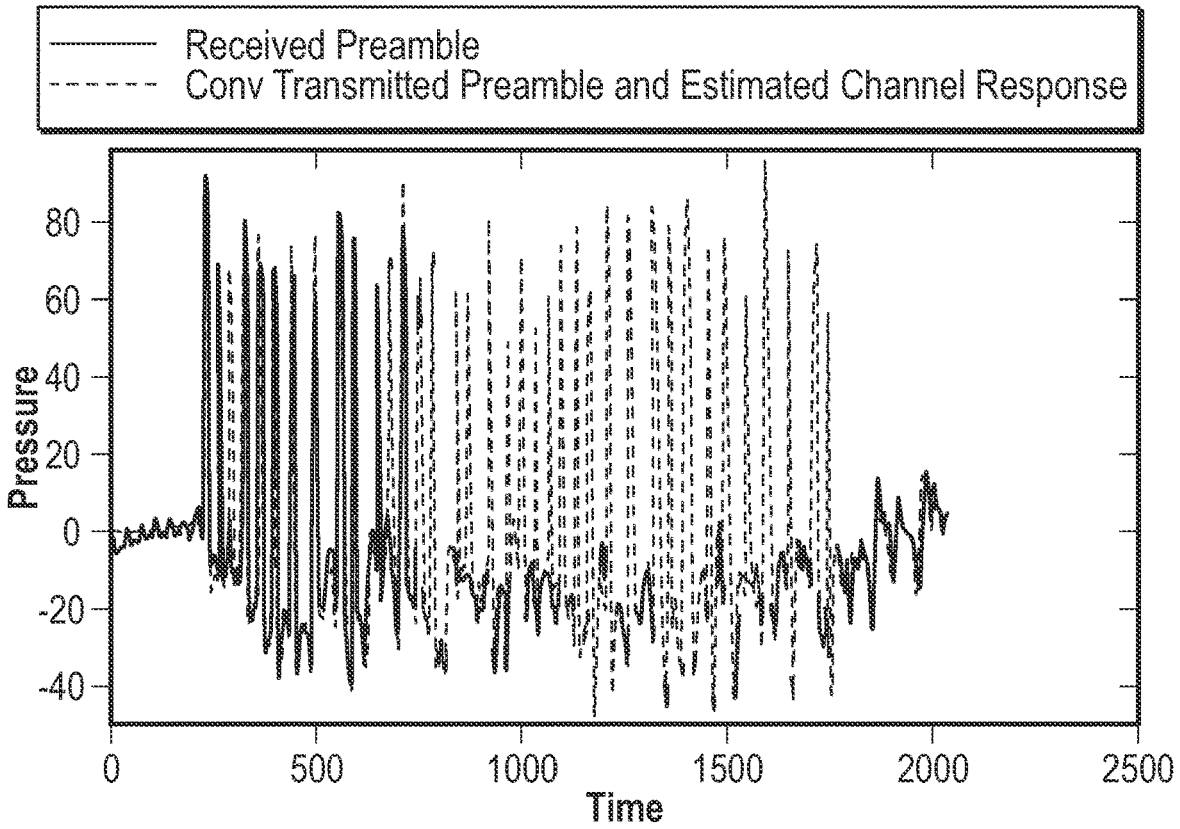
FIG. 7A is a graph showing the comparison between the received pressure waveform due to the transmission of the preamble generated with a stretched pulse width and the convolution between the transmitted preamble and the estimated channel response.
Figure 7B:
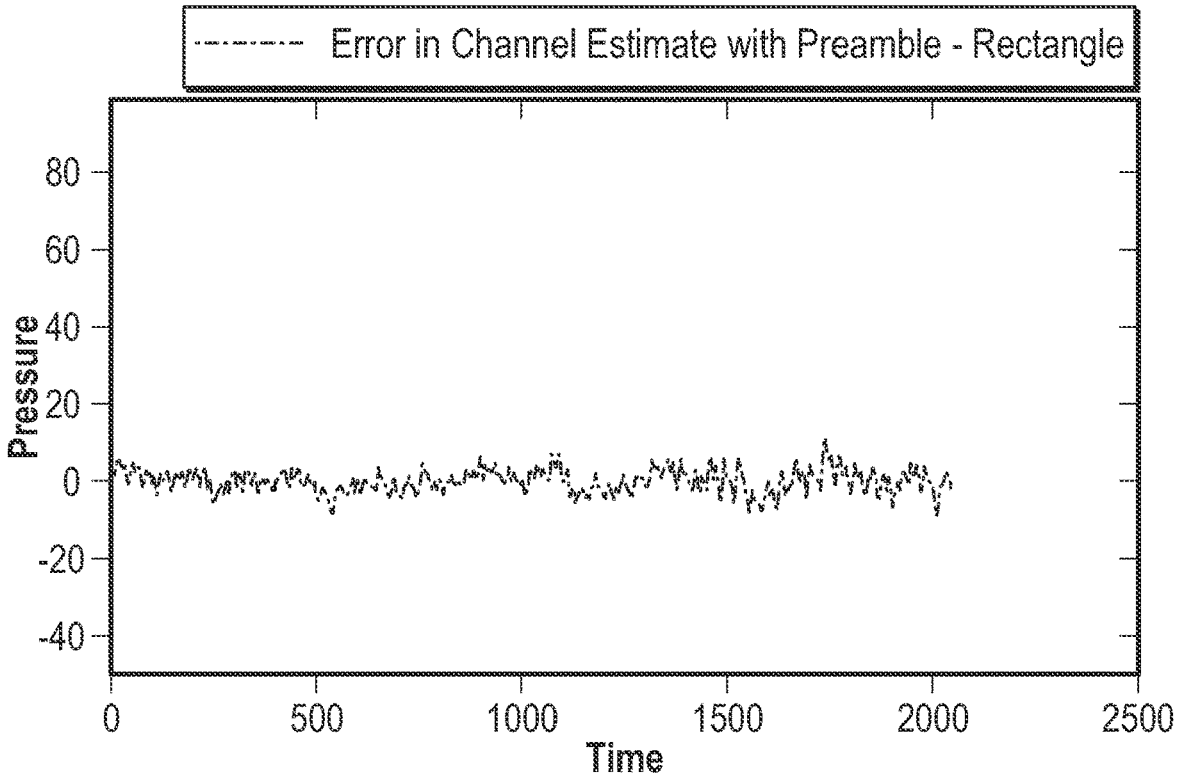
FIG. 7B is a graph showing the channel estimate error calculated from the difference between the two waveforms in FIG. 7A.

To correct this distortion in the pseudorandom spectrum, embodiments of the present disclosure adaptively adjust the pulse duration and width using digitally controlled pulsing parameters. The adaptive adjustment of the pulse width parameter results in a stretched trapezoidal waveform. FIG. 6 is a graph showing a stretched or expanded pulse width that generates the effective pulse also shown in the graph, thereby reducing and/or alleviating the channel estimate error. The use of the stretched pulse width parameter mitigates the mud channel distortion shown in FIGS. 5A and 5B. FIG. 7A is a graph showing the comparison between the received pressure waveform due to the transmission of the preamble generated with a stretched pulse width and the convolution between the transmitted preamble and the estimated channel response. FIG. 7B is a graph showing the channel estimate error calculated from the difference between the two waveforms in FIG. 7A. The use of the stretched pulse width parameter of the present disclosure mitigates the mud channel distortion. Comparing FIG. 7B to FIG. 5B, the error in channel estimate is reduced significantly.

Further, the use of a stretched pulse width in the digitally controlled pulsing parameters also increases the signal-to-noise ratio ("SNR") of the energy because the signal component is proportional to the pulse width. As a result, higher data rate transmission can be achieved with the stretched pulse width since the electric motor response time that defines the minimum achievable rise and fall time will translate into narrower effective pulse width for higher data rate transmission in pulse position modulation scheme.

Figure 8:
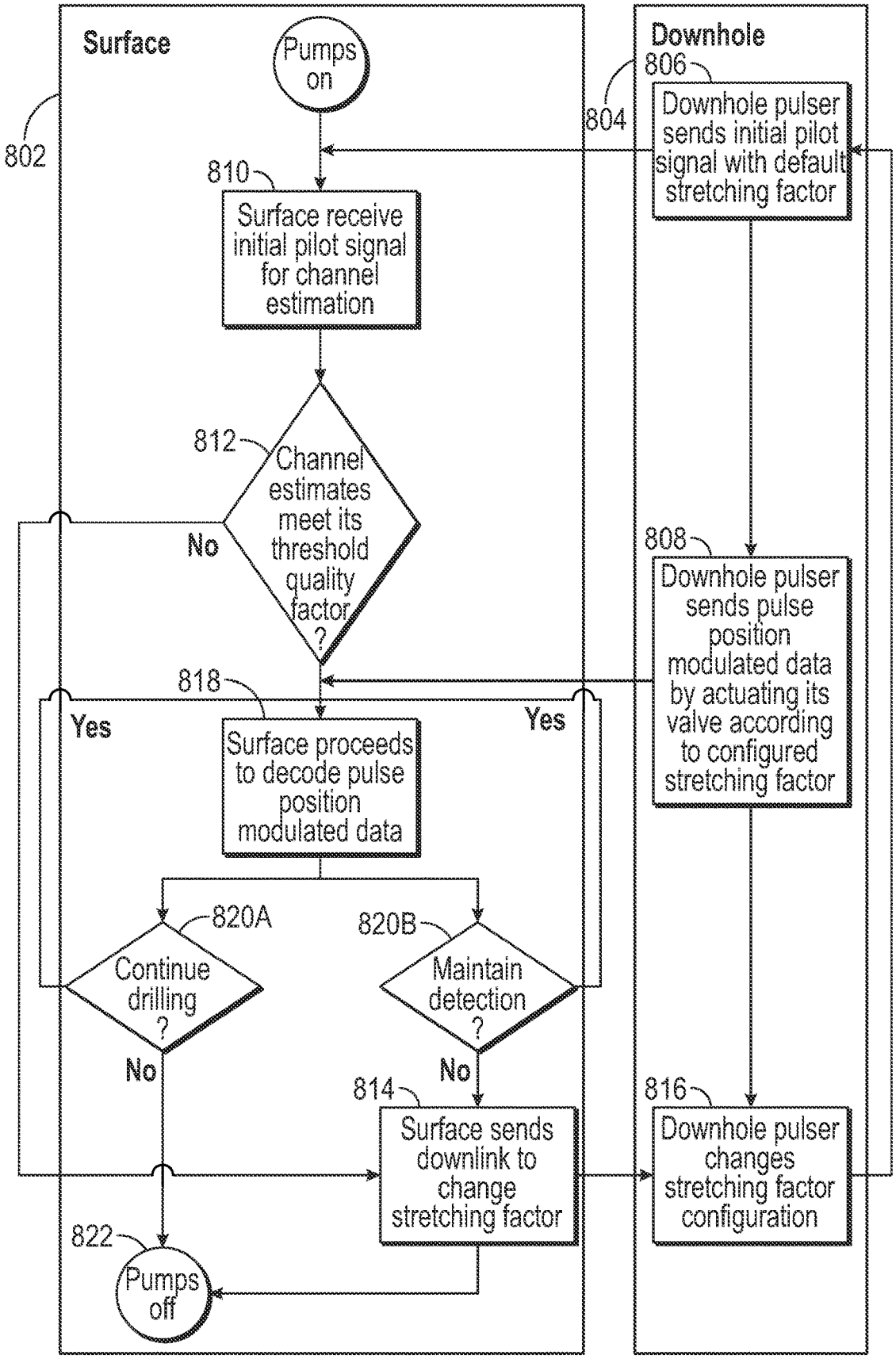
FIG. 8 is a block diagram illustrating an exemplary telemetry method of the present disclosure.

FIG. 8 is a block diagram illustrating an exemplary method of the present disclosure. A surface telemetry unit 802 is communicably coupled to a downhole telemetry unit 804. In this example, a surface controller (e.g., processor 144) and downhole controller (e.g. communication module 134) execute the operations. Although the illustrated method is iterative, this example will begin at block 806 where the controller of the downhole pulser sends an initial pilot signal with a default stretching factor to the surface controller. The stretching factor is taken with respect to the initial pre-configured pulse width. Therefore, a default stretching factor of 1.0 indicates no stretching. At block 808, the downhole pulser generates and transmits a first pulse waveform having modulated data. The first pulse waveform includes a pulse width as defined by the stretching factor.

At block 810, the surface controller receives the initial pilot signal, decodes it, and then estimates the mud channel for mud pulse telemetry in real time or while performing drilling operations. The estimated mud channel can be used to combat noise and achieve higher data rates. The channel estimate can be obtained using a preamble waveform transmitted with data corresponding to a pulse waveform width. Using the preamble waveform, the surface controller estimates a characteristic of a communication channel between a first location (e.g., downhole controller) and the second location (e.g., surface controller). The characteristic of the communication channel can include a noise, a distortion, a delay, an attenuation, a phase shift, a signal-to-noise ratio, an impulse response, an impedance parameter, etc. The characteristic of the communication channel can also include a transfer function. Thus, channel estimation is the process by which the surface controller calculates the channel impulse response from the received noisy preamble signal with the full knowledge of the preamble waveform. During this process, the surface controller also receives the first pulse waveform from the downhole pulser and performs channel estimation at block 812.

At block 812, the surface controller determines whether the channel estimate meets a quality threshold factor. Here, the quality threshold factor may be, for example, a minimum noise, SNR or phase shift present in the received waveform. In one example, the surface controller may calculate the quality score of the channel estimate, then compares the channel estimate quality score to the quality threshold factor to thereby make the determination.

If the surface controller determines the channel estimate does not meet the threshold, at block 814 the surface controller sends a downlink pulse (also referred to as a stretch factor signal), using the mud pump, to change the stretching factor. Here, the stretch factor signal could be to stretch or compress the width of subsequent pulses. In one example, the stretch factor signal comprises a stretching factor parameter represented by $\gamma$ and the adaptive algorithm for adjusting $\gamma$ is governed by the following equation:

$$\gamma_{k+1}=\gamma_k+\mu(q_k-d_k) \quad \text{Eq.1}$$

where $\mu$ is the step size parameter, $q_k$ and $d_k$ denote the calculated and desired quality factors at k-th iteration, respectively. Thus, Equation 1 is applied by the controller to perform a comparison between the calculated and desired quality factors to determine the adjusted stretching factor.

At block 816, the downhole controller receives the stretch factor signal and responsively changes the stretching factor configuration for subsequent pulse waveforms. The configuration change can be to change the width or duration of the pulse waveform. As can be seen in FIG. 2C, the duration of pulse #1 and #2 are essentially the same; however, the width of pulse #1 is shorter than the width of pulse #2. In other embodiments, however, the duration of the pulses may vary as well. Nevertheless, in order to change the width of the pulse waveform, the downhole controller increases or decreases the duration of the pulse waveforms. Thereafter, the method iteratively reverts back to block 808.

Figure 9:
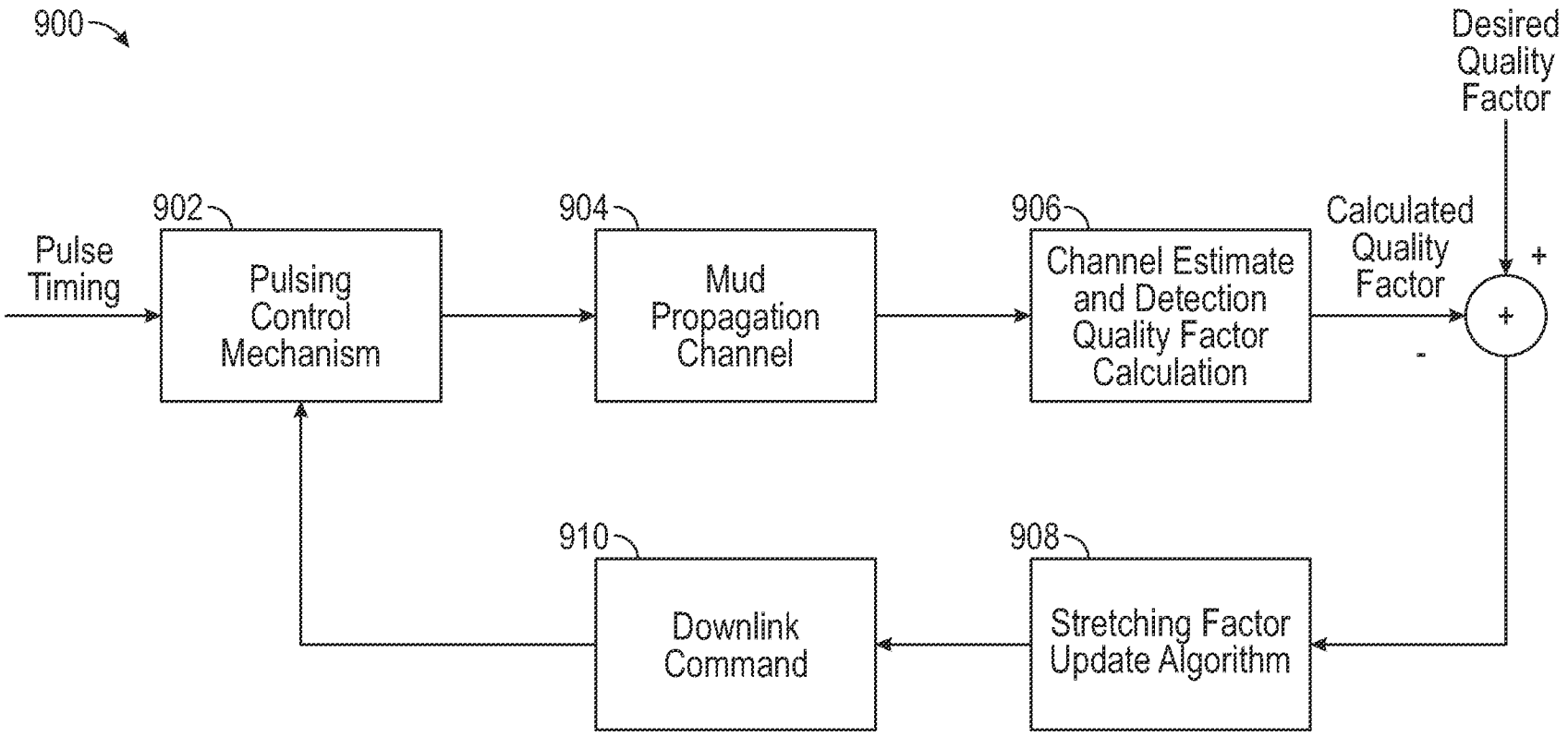
FIG. 9 is a block diagram of the pulse width adaptation process, according to certain illustrative methods of the present disclosure.

Referring back to block 812, if the surface controller determines the channel estimate meets the threshold quality factor, the surface controller proceeds to decode the pulse position modulated data in the pulse waveform at block 818. Using the decoded data, the surface controller determines whether to continue drilling (block 820A) or maintain data pulse waveform detection (block 820B) where, if the answer is "yes," the method iteratively reverts back to block 818. However, if the determination at block 820A is "no," the mud pumps are turned off at block 822. If the determination at block 820B is "no," the surface controller again sends the downlink (stretch factor signal) to adjust the width of subsequent pulses in order to increase the SNR at the surface, thus eliminating the problem of maintaining detection FIG. 9 is a block diagram of the pulse width adaptation process, according to certain illustrative methods of the present disclosure. As in FIG. 8, FIG. 9 describes the coordinated mechanism between the surface controller/mechanisms and downhole controller/pulser. The method may begin when the pumps are switched on to push the drilling fluid into the borehole and end when the pumps are switched off. In method 900, at the downhole controller, the pulse timing instruction is communicated to the pulsing control mechanism at block 902. In response, a mud pulse is generated and propagated uphole by the downhole pulser at block 904. The mud propagation channel varies depending upon the drilling condition and its effect on the telemetry system is captured at the surface from block 906 onwards. At block 906, the surface controller receives the pulse waveforms, performs the channel estimate, and calculates the quality factor of the channel estimate. Equation 1 above is then applied using the calculated quality factor and the desired quality factor to determine if and how the stretching factor should be updated/adjusted at block 908. Thereafter, at block 910 the surface controller transmits the downlink command (stretch factor signal) to the downhole controller to adjust subsequent pulse widths/duration. Thereafter, the adjusted pulse width may be used to perform or adjust a drilling operation.

Figure 10:
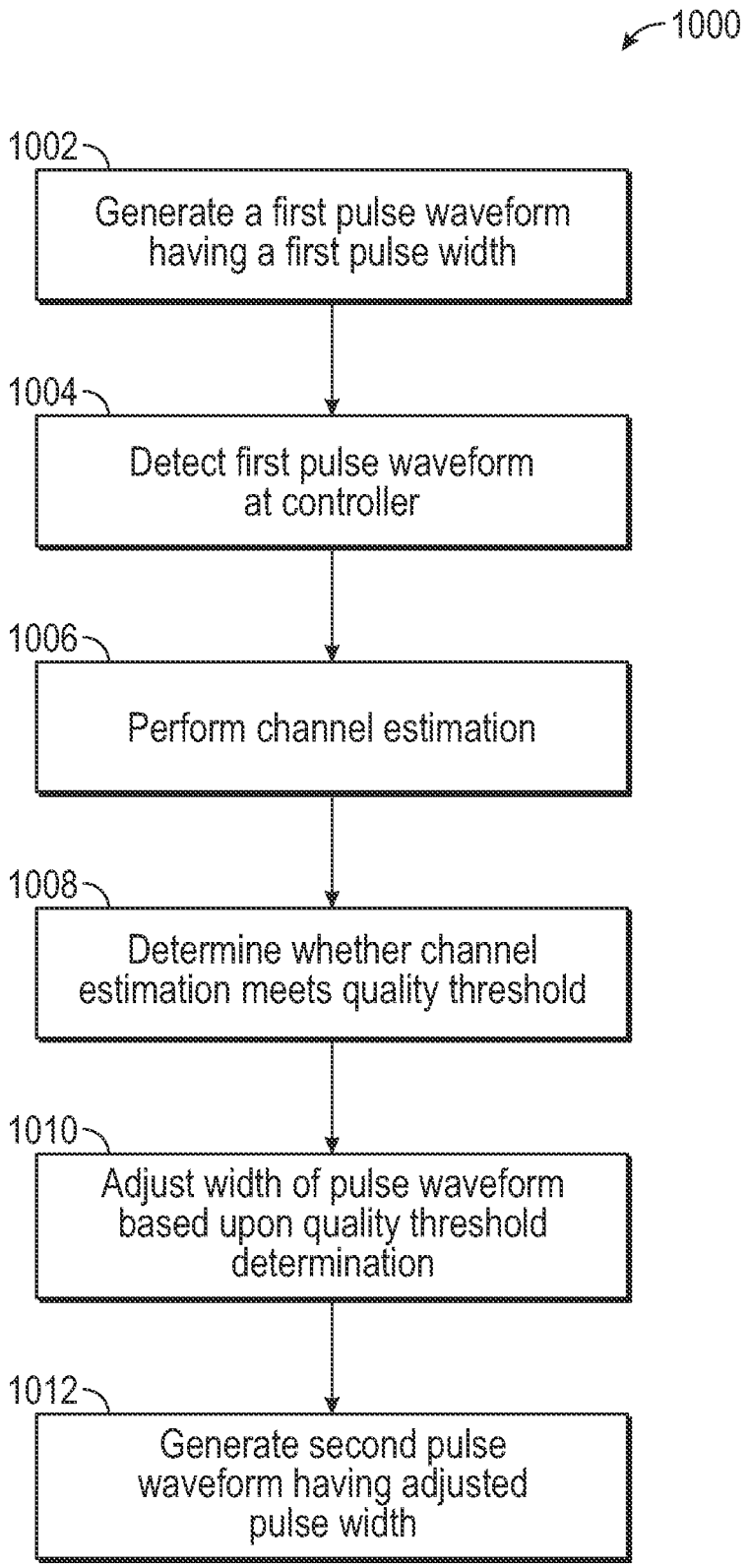
FIG. 10 is a flow chart of a generalized telemetry method for adjusting the width of a pulse waveform, according to certain methods of the present disclosure.

FIG. 10 is a flow chart of a generalized telemetry method for adjusting the width of a pulse waveform, according to certain methods of the present disclosure. At block 1002 of method 1000, the downhole controller (first controller) generates a first pulse waveform having a first pulse width. The waveform is propagated along the wellbore to, in this example, a surface controller (although other controllers along the wellbore may also be used). At block 1004, the first pulse waveform is detected by a second controller. At block 1006, the second controller performs channel estimation of the first pulse waveform. At block 1008, the second controller then determines whether the channel estimation meets a quality threshold, as described herein. At block 1010, responsive to that determination, the second controller transmits a stretch factor signal (downlink signal) to the first controller to adjust the width of the waveform to a second width. At block 1012, the first controller downhole receives the stretch factor signal and generates a second pulse waveform having the second pulse width. The second pulse waveform is then propagated along the wellbore for detection, channel estimation, etc. and the method continues iteratively.

The adjusted pulse width methodologies described herein may be utilized in a variety of applications, such as to conduct a variety of wellbore operations such as, for example, to perform a drilling operation or adjust a drilling operation.

Embodiments and methods described herein further relate to any one or more of the following paragraphs:

1. A computer-implemented downhole telemetry method, comprising generating a first pulse waveform using a first controller communicably coupled to a downhole pulser, the first pulse waveform having a first pulse width; propagating the first pulse waveform along a wellbore; detecting the first pulse waveform at a second controller; estimating a channel of the detected first pulse waveform; determining whether the channel estimate meets a quality threshold; responsive to a determination the channel estimate does not meet the quality threshold, transmitting a stretch factor signal from the second controller to the first controller to adjust the first pulse width to a second pulse width; generating a second pulse waveform having the second pulse width using the first controller; propagating the second pulse waveform along the wellbore; and detecting the second pulse waveform at the second controller.
2. The computer-implemented method as defined in paragraph 1, wherein the first pulse waveform is generated using an initial stretch factor signal sent from the second controller.
3. The computer-implemented method as defined in paragraphs 1 or 2, wherein: the channel estimate is a characteristic of the channel; and determining whether the channel estimate meets a quality threshold comprises determining whether the characteristic of the channel meets a quality threshold.
4. The computer-implemented method as defined in any of paragraphs 1-3, wherein transmitting the stretch factor signal comprises calculating a quality factor of the channel estimate; comparing the calculated quality factor to a desired quality factor; based upon that comparison, calculating or adjusting the stretch factor signal.
5. The computer-implemented method as defined in any of paragraphs 1-4, wherein the stretch factor signal is calculated or adjusted using: $\gamma_(k+1)=\gamma_k-+\mu(q_k-d_k)$, where $\gamma$ is the stretch factor, $\mu$ is the step size parameter, q_k is the calculated quality factor and d_k is the desired quality factors at a k-th iteration.
6. The computer-implemented method as defined in any of paragraphs 1-5, further comprising performing a wellbore operation using the detected second pulse waveform.
7. The computer-implemented method as defined in any of paragraphs 1-6, further comprising adjusting a drilling operation using the detected second pulse waveform.
8. A downhole telemetry system, comprising a mud pulse system having components to generate mud pulse telemetry signals; and processing circuitry coupled to the mud pulse system, the processing circuitry being operable to perform a method comprising: generating a first pulse waveform using a first controller communicably coupled to a downhole pulser, the first pulse waveform having a first pulse width; propagating the first pulse waveform along a wellbore; detecting the first pulse waveform at a second controller; estimating a channel of the detected first pulse waveform; determining whether the channel estimate meets a quality threshold; responsive to a determination the channel estimate does not meet the quality threshold, transmitting a stretch factor signal from the second controller to the first controller to adjust the first pulse width to a second pulse width; generating a second pulse waveform having the second pulse width using the first controller; propagating the second pulse waveform along the wellbore; and detecting the second pulse waveform at the second controller.
9. The system as defined in paragraph 8, wherein the first pulse waveform is generated using an initial stretch factor signal sent from the second controller.
10. The system as defined in paragraphs 8 or 9, wherein the channel estimate is a characteristic of the channel; and determining whether the channel estimate meets a quality threshold comprises determining whether the characteristic of the channel meets a quality threshold.
11. The system as defined in any of paragraphs 8-10, wherein transmitting the stretch factor signal comprises calculating a quality factor of the channel estimate; comparing the calculated quality factor to a desired quality factor; and based upon that comparison, calculating or adjusting the stretch factor signal.
12. The system as defined in any of paragraphs 8-11, wherein the stretch factor signal is calculated or adjusted using: $\gamma_(k+1)=\gamma_k+\mu(q_k-d_k)$, where $\gamma$ is the stretch factor, $\mu$ is the step size parameter, q_k is the calculated quality factor and d_k is the desired quality factors at a k-th iteration.
13. The system as defined in any of paragraphs 8-12, further comprising performing a wellbore operation using the detected second pulse waveform.
14. The system as defined in any of paragraphs 8-13, further comprising adjusting a drilling operation using the detected second pulse waveform.

Furthermore, any of the illustrative methods described herein may be implemented by a system comprising processing circuitry or a non-transitory computer readable medium comprising instructions which, when executed by at least one processor, causes the processor to perform any of the methods described herein.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A computer-implemented downhole telemetry method, comprising:

generating a first pulse waveform based on an initial pilot signal of the first pulse waveform that is iteratively adjusted using a stretch factor signal to affect distortion through a mud channel in performing mud pulse telemetry using a first controller communicably coupled to a downhole pulser, the first pulse waveform having a first pulse width;

propagating the first pulse waveform along a wellbore through the mud channel;

detecting the first pulse waveform at a second controller;

estimating the distortion of the mud channel based on the detected first pulse waveform in relation to the stretch factor signal;

determining whether the channel estimate meets a quality threshold;

responsive to a determination the channel estimate does not meet the quality threshold:

iteratively adjusting the stretch factor signal to generate an adjusted stretch factor signal; and transmitting the adjusted stretch factor signal from the second controller to the first controller to adjust the first pulse width to a second pulse width;

generating a second pulse waveform having the second pulse width based on the adjusted stretch factor signal using the first controller;

propagating the second pulse waveform along the wellbore through the mud channel; and detecting the second pulse waveform at the second controller.

2. The computer-implemented method as defined in claim 1, wherein the first pulse waveform is generated using an initial stretch factor signal sent from the second controller.

3. The computer-implemented method as defined in claim 1, wherein:

the channel estimate is a characteristic of the channel; and determining whether the channel estimate meets a quality threshold comprises determining whether the characteristic of the channel meets a quality threshold.

4. The computer-implemented method as defined in claim 1, wherein transmitting the stretch factor signal comprises:

calculating a quality factor of the channel estimate;

comparing the calculated quality factor to a desired quality factor; and based upon that comparison, calculating or adjusting the stretch factor signal.

5. The computer-implemented method as defined in claim 4, wherein the stretch factor signal is calculated or adjusted using:

$$\gamma_{k+1}=\gamma_k+\mu(q_k-d_k)$$

where $\gamma$ is the stretch factor, $\mu$ is the step size parameter, $q_k$ is the calculated quality factor and $d_k$ is the desired quality factors at a k-th iteration.

6. The computer-implemented method as defined in claim 1, further comprising performing a wellbore operation using the detected second pulse waveform.

7. The computer-implemented method as defined in claim 1, further comprising adjusting a drilling operation using the detected second pulse waveform.

8. A downhole telemetry system, comprising:

a mud pulse system having components to generate mud pulse telemetry signals; and processing circuitry coupled to the mud pulse system, the processing circuitry being operable to perform a method comprising:

generating a first pulse waveform based on an initial pilot signal fo the first pulse waveform that is iteratively adjusted using a stretch factor signal to affect distortion through a mud channel in performing mud pulse telemetry using a first controller communicably coupled to a downhole pulser, the first pulse waveform having a first pulse width;

propagating the first pulse waveform along a wellbore through the mud channel;

detecting the first pulse waveform at a second controller;

estimating the distortion of the mud channel based on the detected first pulse waveform in relation to the stretch factor signal;

determining whether the channel estimate meets a quality threshold;

responsive to a determination the channel estimate does not meet the quality threshold:

iteratively adjusting the stretch factor signal to generate an adjusted stretch factor signal; and transmitting the adjusted stretch factor signal from the second controller to the first controller to adjust the first pulse width to a second pulse width;

generating a second pulse waveform having the second pulse width based on the adjusted stretch factor signal using the first controller;

propagating the second pulse waveform along the wellbore through the mud channel; and detecting the second pulse waveform at the second controller.

9. The system as defined in claim 8, wherein the first pulse waveform is generated using an initial stretch factor signal sent from the second controller.

10. The system as defined in claim 8, wherein:

the channel estimate is a characteristic of the channel; and determining whether the channel estimate meets a quality threshold comprises determining whether the characteristic of the channel meets a quality threshold.

11. The system as defined in claim 8, wherein transmitting the stretch factor signal comprises:

calculating a quality factor of the channel estimate;

comparing the calculated quality factor to a desired quality factor; and based upon that comparison, calculating or adjusting the stretch factor signal.

12. The system as defined in claim 11, wherein the stretch factor signal is calculated or adjusted using:

$$\gamma_{k+1}-\gamma_k+\mu(q_k-d_k)$$

where $\gamma$ is the stretch factor, $\mu$ is the step size parameter, $q_k$ is the calculated quality factor and $d_k$ is the desired quality factors at a k-th iteration.

13. The system as defined in claim 8, further comprising performing a wellbore operation using the detected second pulse waveform.

14. The system as defined in claim 8, further comprising adjusting a drilling operation using the detected second pulse waveform.

15. A non-transitory computer readable medium comprising instructions which, when executed by at least one processor, causes the processor to perform a method comprising:

generating a first pulse waveform based on an initial pilot signal of the first pulse waveform that is iteratively adjusted using a stretch factor signal to affect distortion through a mud channel in performing mud pulse telemetry using a first controller communicably coupled to a downhole pulser, the first pulse waveform having a first pulse width;

propagating the first pulse waveform along a wellbore through the mud channel;

detecting the first pulse waveform at a second controller;

estimating the distortion of the mud channel based on the detected first pulse waveform in relation to the stretch factor signal;

determining whether the channel estimate meets a quality threshold;

responsive to a determination the channel estimate does not meet the quality threshold:

iteratively adjusting the stretch factor signal to generate an adjusted stretch factor signal; and transmitting the adjusted stretch factor signal from the second controller to the first controller to adjust the first pulse width to a second pulse width;

generating a second pulse waveform having the second pulse width based on the adjusted stretch factor signal using the first controller;

propagating the second pulse waveform along the wellbore through the mud channel; and detecting the second pulse waveform at the second controller.

16. The computer readable medium as defined in claim 15, wherein the first pulse waveform is generated using an initial stretch factor signal sent from the second controller.

17. The computer readable medium as defined in claim 15, wherein:

the channel estimate is a characteristic of the channel; and determining whether the channel estimate meets a quality threshold comprises determining whether the characteristic of the channel meets a quality threshold.

18. The computer readable medium as defined in claim 15, wherein transmitting the stretch factor signal comprises:

calculating a quality factor of the channel estimate;

comparing the calculated quality factor to a desired quality factor; and based upon that comparison, calculating or adjusting the stretch factor signal.

19. The computer readable medium as defined in claim 18, wherein the stretch factor signal is calculated or adjusted using:

$$\gamma_{k+1}=\gamma_k+\mu(q_k-d_k)$$

where $\gamma$ is the stretch factor, $\mu$ is the step size parameter, $q_k$ is the calculated quality factor and $d_k$ is the desired quality factors at a k-th iteration.

20. The computer readable medium as defined in claim 15, further comprising performing or adjusting a drilling operation using the detected second pulse waveform.

* * * * *